United States Patent [19]

MacKay

[11] 4,427,173

[45] Jan. 24, 1984

[54] SELF-LEVELING SLEEVE INSERT FOR CONCRETE PASSAGES

[76] Inventor: Robert K. MacKay, 44 Irving Dr., South Walpole, Mass. 02071

[21] Appl. No.: 350,985

[22] Filed: Feb. 22, 1982

[51] Int. Cl.[3] ..... E04G 15/00

[52] U.S. Cl. ..... 249/39; 249/93; 249/94; 249/177

[58] Field of Search ..... 249/39, 146, 147, 148, 249/177, 83, 85, 88, 96, 97, 93, 94

[56] References Cited

U.S. PATENT DOCUMENTS

| | | | |
|---|---|---|---|
| 1,309,084 | 7/1919 | Zimmerman | 249/177 |
| 1,908,796 | 5/1933 | Suchan | 249/177 |
| 2,234,784 | 3/1941 | Stolz | 25/128 |
| 2,968,855 | 1/1961 | Stolz | 25/128 |
| 3,523,552 | 8/1970 | Ogden | 137/592 |
| 4,079,912 | 3/1978 | Haydock | 249/184 |
| 4,159,099 | 6/1979 | Maguire | 249/93 |

FOREIGN PATENT DOCUMENTS

| | | | |
|---|---|---|---|
| 1134455 | 4/1957 | France | 249/39 |

*Primary Examiner*—Donald E. Czaja
*Assistant Examiner*—James C. Housel
*Attorney, Agent, or Firm*—Donald W. Meeker

[57] ABSTRACT

A cast iron pipe sleeve is provided at each end with a tight-fitting metal disk. A threaded steel rod is screwed into a nut welded in the center of the inside face of a solid disk. The disk rests against the outer edge of the sleeve and the rod extends through the interior of the sleeve and out through a hole in the center of the opposite disc and further through a hole in one of the form walls. A long bar or channel provided with a center hole is placed over the end of the rod and across two external studs on the form wall. As a nut is tightened onto the end of the rod against the channel, the sleeve is drawn securely and squarely against the form wall. After the other form wall is secured in place tightly against the solid disc end of the sleeve, the concrete is poured and cured, the exterior nut is removed, the form walls are removed, and the discs and rod are removed to be reused. The sleeve remains cast in the concrete as a cylindrical passage through the thickness of the concrete for pipes. One alternate embodiment provides an interior disc bolted within the sleeve. Another embodiment provides a sleeve extending completely through the form with a bent bar bolted to the form a distance of two sides of the sleeve.

7 Claims, 5 Drawing Figures

SELF-LEVELING SLEEVE INSERT FOR CONCRETE PASSAGES

DESCRIPTION

1. Technical Field

Apparatus for use with panels in a molded structure such as forms for poured concrete construction, having means extending through or abutting against at least one panel to form an opening extending through the major face of the molded structure.

2. Background Art

In reinforced concrete structures, providing a passageway through a wall for pipes or other utilities has consumed a considerable amount of time requiring two men five days to install a passageway sleeve properly.

Prior art devices required great effort to climb in among the reinforcement bars between concrete forms to install a pipe sleeve.

In the past alignment of pipe sleeves was a major problem in fitting the sleeve around the reinforcing bars and assuring a level placement fitting squarely with the form walls.

Considerable wire and other material has been required to secure a pipe sleeve to the reinforcing bars, and the material was left in place within the wall after the concrete was poured.

Other sleeves have required considerable tie-in means to the reinforcing bars or attachment to both form walls or both to provide the strength necessary to resist the tremendous load placed upon the sleeve by the heavy poured concrete.

Some prior art sleeves provided uneven interior passages because of soft bendable shells, overlapping tubes, undulating shells, tapered elements or parts remaining attached to the sleeves.

DISCLOSURE OF INVENTION

With the present invention considerable time and labor costs are saved because the sleeve can be properly installed by two workers in twenty minutes.

Because the present invention may be installed to a single form wall before the reinforcement bars and opposite form wall are in place, installation requires little effort having easy access to the work area.

Self-alignment is built into the present invention with a flat sleeve end and a broad support outside the form to pull the sleeve squarely against the single form wall, thereby assuring an accurate square and level fit automatically.

With the single self-securing form clamping system of the present insert considerable material is saved especially since the entire insert within the sleeve may be removed from the sleeve when the forms are removed and the entire insert reused for other sleeve installations.

Providing a broad support member which spans the ribs on the outside of the form wall creates a substantial moment arm to resist the forces placed upon the sleeve by the weight of the heavy poured concrete and thereby is a secure self-supporting attachment for the sleeve to a single form wall.

With a fully removable insert inside a smooth self-supporting sleeve which passes completely through the wall and remains in place, the present invention provides a completely smooth passageway through the wall and beyond if desired.

BRIEF DESCRIPTION OF DRAWINGS

These and other details and advantages of my invention will be described in connection with the accompanying drawings, which are furnished only by way of illustration but not in limitation of the invention, and in which drawings.

BEST MODE FOR CARRYING OUT THE INVENTION

Figure 1:
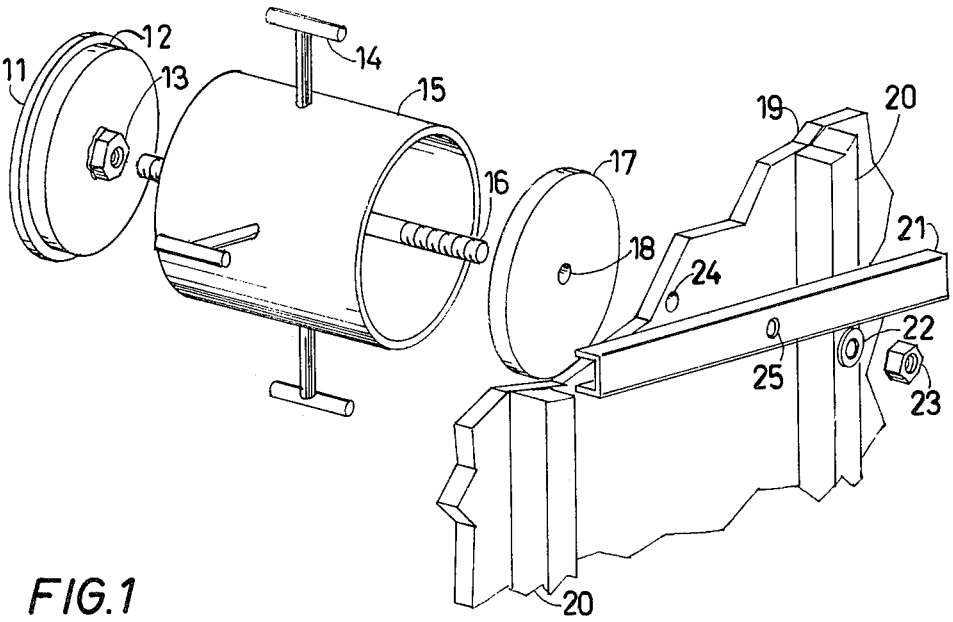
FIG. 1 is a perspective view of the components of the invention aligned for assembly with the form wall shown in broken section.

In FIG. 1 the sleeve 15 is a rigid hollow cylinder preferably made of metal such as a section of cast iron pipe. Attached by welding around the exterior surface of the pipe are standard protruding studs 14 which become surrounded by the concrete when it is poured.

A flat circular disc, also preferably of metal such as sheet steel, forms a solid end cap 11 provided around its perimeter with a 1/16" sleeve 12 which rests against one end of the sleeve 15 to form a flat covering to enclose the end of the sleeve. Welded to the center of the solid end cap 11 is a nut 13 which receives the threaded interior end of a rigid rod 16 preferably of metal such as steel. The rod forms an elongated protrusion extending from the solid end cap 11 at one end of the sleeve through the center of the sleeve 15 and out the other end.

At the other end a second end cap 17 is a rigid circular disc fabricated of any stiff sheet material such as wood or metal. Slighly smaller than the interior diameter of the sleeve, the second end cap 17 fits snugly inside the end of the sleeve with a friction fit. Centrally located in the second end cap 17 a circular cap hole 18 through the cap is just large enough to admit the rod 16 therethrough and hold the rod securely in the center of the sleeve 15.

The form wall 19, which may be provided with support studs 20 spaced across its outer surface, is further provided with a wall hole 24 of sufficient diameter to admit the rod 16 therethrough. The wall hole 24 is preferably located centrally between two support studs 20, although it may be located anywhere on the wall as required for pipe location.

A rigid cross-member 21 such as a length of steel channel is provided with a central channel opening 25 just large enough to admit the rod 16.

The entire sleeve apparatus is easily installed by two workers in twenty minutes. After one form wall 19 has been erected, before the reinforcing bars are put into place, a form hole 24 is drilled through the form wall 19 at the point in the wall where the centerline of the pipe or other utility conduit will pass through the wall.

Figure 2:
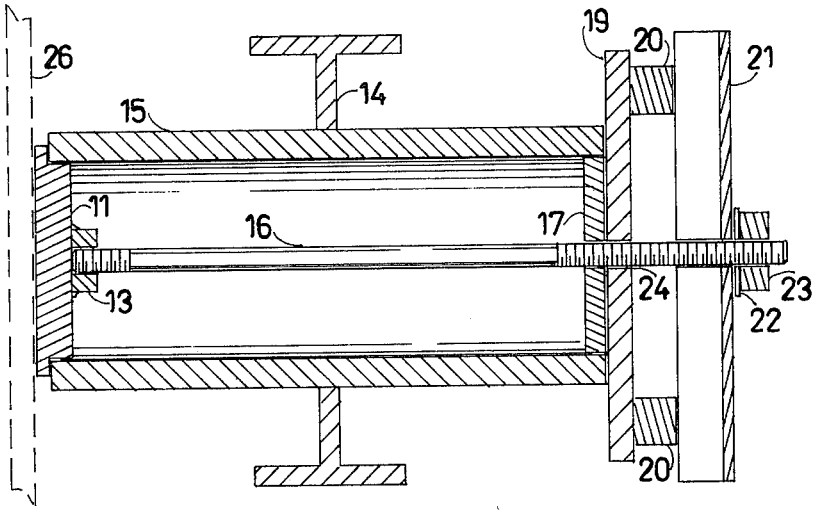
FIG. 2 is a cross-sectional view of the preferred embodiment invention taken through the centerline of the sleeve as installed on the form wall.

As seen in FIG. 2, the rod 16 is screwed securely into the nut 13 which is welded to the center of the inner face of the solid end cap 11. After forcing the second end cap 17 into one end of the sleeve, the rod 16 is then inserted in the opposite end of the sleeve 15 through the inside of the sleeve and out through the cap hole 18 until the solid end cap 11 is secured over the opening to the sleeve with the peripheral flange 12 contacting the end face of the sleeve.

By lifting the sleeve 15, the end of the rod 16 is then inserted by one workman through the form hole 24 until the flat end of the sleeve contacts the inner surface of the form wall 19. A second workman then slides cross-member 21 over the end of the rod 16 until the cross-member 21 contacts the support studs 20, or the form wall itself if there are no support studs.

The second workman then secures the cross-member 21 very tightly onto the rod and against the sleeve by applying a nut 23 and washer 22 to the end of the rod 16. Tightening a nut 23 draws the sleeve squarely and securely against the inner surface of the form wall 19. Accurate placement and leveling of the sleeve are provided automatically because the holes are aligned and the sleeve surface conforms to the inner wall surface. Resistance of the sleeve to movement by the heavy concrete is provided by the leverage of the long moment arm provided by the cross-member 21 extending over a substantial portion of the outer surface of the form wall beyond the perimeter of the sleeve.

Reinforcing rods may then be installed and the opposing form wall 26 (dashed lines) erected with its inner surface abutting the outer flat face of the solid end cap 11. Concrete is then poured between the forms 26 and 19 and allowed to set. After the concrete has set in the desired structural form, the securing nut 23 may be unscrewed and the cross-member 21 removed. Both form walls 19 and 26 may then be removed and the remaining rod 16 and two end caps 11 and 17 removed from the sleeve 15 which remains embedded in the concrete structure to provide a smooth lined passageway therethrough for pipes or other utility conduits. The sleeve insert, including the two end caps 11 and 17, the rod 16, the cross-member 21 and securing nut 23 and washer 22, may all be reused in other sleeves for other passageways.

Figure 3:
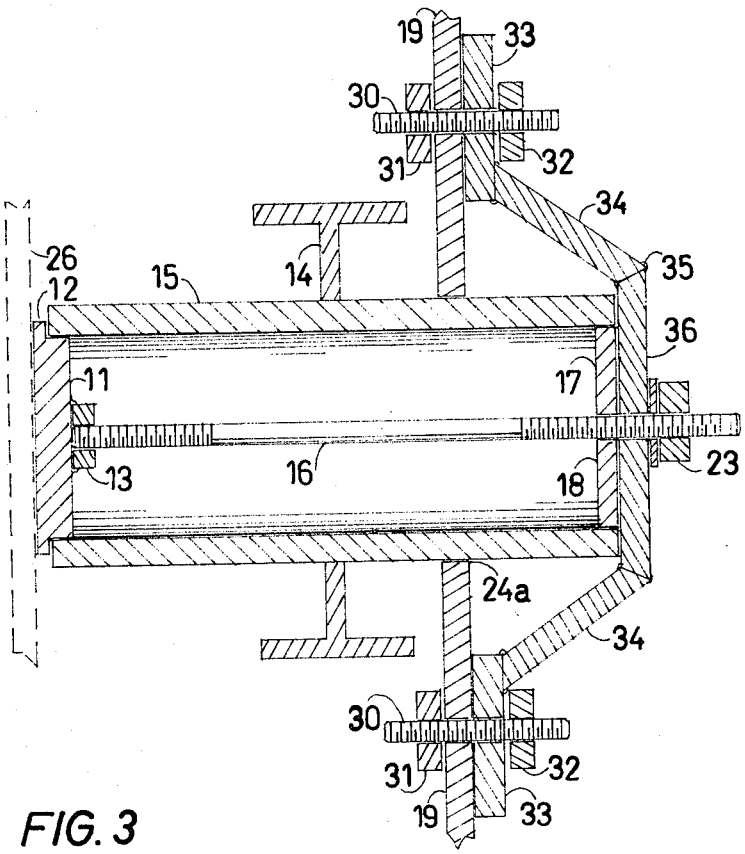
FIG. 3 is the sectional view of an alternate embodiment of the invention taken through the centerline of the sleeve as installed with the sleeve through the form wall.

In FIG. 3 an alternate embodiment of the invention provides a pipe sleeve 15 which extends beyond the face of the concrete structure being formed. In this case, the hole 24A in the form wall is sufficiently large in diameter to accomodate and hold securely the entire sleeve 15. Two smaller bolt-size holes are provided in the form wall equally offset from the sleeve hole. To accomodate the structural difference in the attachment to the form wall, the cross-member 35 in this case is angular, comprising a flat rod-securing portion 36 provided with an opening to admit the rod 16, welded at an angle to each of two equal angled portions 34, each further welded at a supplementary angle to each of two wall-securing portions 33, each provided with a hole therethrough. The angular cross-member 35 may be fabricated of metal bars welded together.

After the two end caps 11 and 17 and rod 16 are in place within the sleeve 15, the sleeve is inserted through the large wall opening 24A from the inside wall surface to the outside with the rod protruding outwardly. The angled cross-member is secured to the end of the rod 16 by a nut 23 and secured to the form wall 19 by each of two threaded bolt rods 30 and nuts 31 and 32, by nuts and bolts or by other fastening means through the wall-securing portions 33. The rest of the procedure is the same as in the preferred embodiment, except that the result is a pipe sleeve which extends beyond the concrete structure as well as through it. Nuts 31 and the end of the bolt rods 30 remain embedded in the structure after the forms 19 and 26 are removed and the outer ends of the bolt rods 30 may protrude or be broken off.

Figure 4:
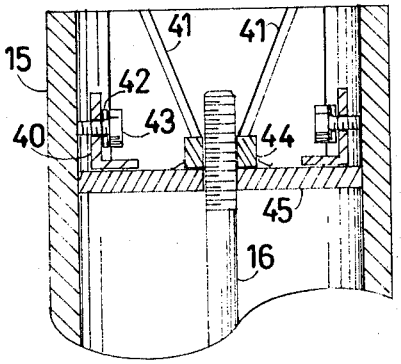
FIG. 4 is a partial sectional view taken through 4—4 of FIG. 5, showing an alternate embodiment of the invention with a recessed sleeve insert.
Figure 5:
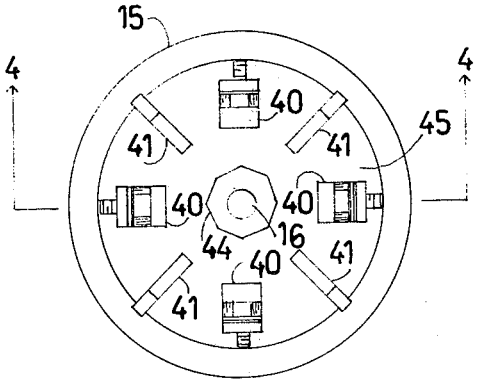
FIG. 5 is an end elevational view of the alternate embodiment of the invention showing the recessed sleeve insert.

The FIGS. 4 and 5 an alternate embodiment of the invention provides a recessed end plate 45 which is set down into the sleeve so that no part of the insert protrudes beyond the end of the sleeve. Wedges 41 formed of metallic plate are welded perpendicularly to the recessed end plate 45 in a spaced arrangement around the periphery of the plate touching the interior of the sleeve. The end of each wedge extends outwardly into a notch in the interior surface of the sleeve, to engage the insert in the sleeve. Intermittently spaced with the wedges are angles 40 welded to the outer surface of the end plate. Each angle is provided with a threaded hole or a hole and nut 42 welded to the angle so that a bolt 43 or other threaded fastener may be threaded through the angle against the inner surface of the sleeve to secure the end plate within the sleeve. The end plate 45 is provided with a central opening through which the rod 16 passes and the rod 16 is secured adjustably therein by a bolt 44 which may be welded to the plate 45. The recessed plate insert enables the end of the sleeve to be aligned evenly with the face of the concrete structure.

Although metal is the preferred material for the sleeve and insert, other materials such as plastic could be used, if it were of structural quality to sustain the heavy weight of the concrete. The securing device with the protruding rod and cross-member could be applied to both forms if necessary for extra strength, although applying the attaching means to one form is preferred for each of installation. Another use would provide a passage only part of the way through the structure by leaving a space between the solid plate 11 and the non-attached form 26. The device may be applied for passages through any forming material such as concrete and through any structural member such as walls, floors or ceilings. Although the preferred embodiment of the sleeve is cylindrical in shape for pipe passages, other shapes of sleeves may be used for other purposes, such as a box-like sleeve for rectangular air ducts.

It is understood that the preceding description is given merely by way of illustration and not in limitation and that various modifications may be made thereto without departing from the spirit of the invention as claimed.

I claim:

1. A pipe sleeve device for forming a passage through a concrete structure used in conjunction with a vertical form wall, which device is rigidly self-aligned and totally secured by attaching the device to a single vertical form wall and the device comprises:

a first form wall provided with an interior surface which contacts the concrete, an exterior surface and a hole through the wall connecting the two surfaces;

a rigid hollow sleeve around which concrete may be poured and which thereby forms a passage in the concrete, which sleeve is provided with an opening at each end forming a clear passage through the hollow sleeve, and which sleeve is located interiorly of the form wall;

a first solid end cap covering one sleeve opening and removably secured thereto;

a second end cap covering the other sleeve opening, which second end cap is provided with a small central opening therethrough and which second end cap fits tightly and removably within the sleeve opening, wherein the second end cap opening is aligned with the wall hole to assure alignment of the device;

a rigid rod elongated member centrally located within the sleeve, secured to the interior of the first end cap, and extending out through the opening in the second end cap, wherein the extended end of the rod passes through the opening in the form wall;

a rigid cross-member secured to the end of the rod exteriorly of the form wall spanning a substantial portion of the wall;

a rod fastener means to create a compressive force between the cross-member and the sleeve to pull the first end cap against the sleeve and the sleeve against the first form wall to sandwich the wall securely therebetween, so that the device is sufficiently secured to the first form wall to resist the weight of the concrete;

a second vertical form wall which merely abuts the first end cap and which second form wall is secured to the first form wall by means independent of the device for receiving poured concrete between the form walls.

2. The invention of claim 1 wherein the elongated member is provided with a threaded inner end and the first end cap is provided on an interior face only with a threaded opening to receive the elongated member and removably secure the member to the sleeve, thereby leaving a smooth exterior face of the first end cap for a flush abutment against the second form wall.

3. The invention of claim 2 wherein the threaded opening is a nut welded to the interior face of the the first end cap.

4. The invention of claim 1 wherein the exterior surface of the first form wall is provided with structural steel ribs and the elongated member spans at least two ribs.

5. The invention of claim 1 wherein the first end cap is larger than the end opening of the sleeve by a thin steel lip around the perimeter of the end cap which lip covers a portion of the sleeve end and which first end cap is held removably against the outside of the sleeve by the force of the elongated member.

6. The invention of claim 1 wherein the first end cap is slightly smaller than the sleeve opening and the first end cap is recessed within the sleeve and removably secured therein by means of at least three metal angles secured to the first end cap, each of which metal angles is provided with a threaded opening through which a threaded fastener is screwed tightly against the interior of the sleeve.

7. A pipe sleeve device for forming a passage through a concrete structure used in conjunction with a vertical form wall, which device is rigidly self-aligned and totally secured by attaching the device to a single vertical form wall with the pipe sleeve protruding through the form wall to which the sleeve is attached, and the device comprises:

a first form wall provided with an interior surface which contacts the concrete, an exterior surface and an interconnecting hole through the wall just large enough to admit a cross-section of the pipe sleeve which protrudes through the first form wall;

a rigid hollow sleeve around which concrete may be poured and which thereby forms a passage in the concrete, which sleeve is provided with an opening at each end forming a clear passage through the hollow sleeve, and which sleeve protrudes through the interconnecting hole in the first form wall;

a first solid end cap covering one sleeve opening located interiorly of the first form wall, which first end cap is removably secured to the interiorly located sleeve opening;

an angular elongated member secured to the protruding end of the sleeve, which angular member extends beyond the periphery of the sleeve in at least two directions over a portion of the wall and which angular member is provided with a small opening centrally located over the sleeve opening and which angular member in its extended portions angles from the protruding sleeve end to the form wall to which wall the angular member is removably secured;

a rigid rod elongated member centrally located within the sleeve, secured to the interior of the first end cap, and extending out through the small opening in the angular member to which the rod is secured;

a rod fastener means to create a compressive force between the angular member and the sleeve by pulling the first end cap against the sleeve and the sleeve against the angular member, so that the device is sufficiently secured to the first form wall to resist the weight of the concrete;

a second vertical form wall which merely abuts the first end cap and which second form wall is secured to the first form wall by a means independent of the device for receiving poured concrete between the form walls.

* * * * *